US006154944A

United States Patent [19]

Mason et al.

[11] Patent Number: 6,154,944

[45] **Date of Patent: *Dec. 5, 2000**

[54] METHOD FOR EXPANSION FORMING OF TUBING

[75] Inventors: Murray R. Mason; Gerrald A. Klages, both of Woodstock, Canada

[73] Assignee: TI Corporate Services Limited, London, United Kingdom

[ * ] Notice: This patent is subject to a terminal disclaimer.

[21] Appl. No.: 09/119,519

[22] Filed: Jul. 21, 1998

Related U.S. Application Data

[63] Continuation of application No. 08/808,934, Feb. 28, 1997, Pat. No. 5,815,901, which is a continuation of application No. 08/567,721, Dec. 5, 1995, Pat. No. 5,644,829, which is a continuation of application No. 08/106,752, Aug. 16, 1993, abandoned.

[51] Int. Cl.[7] ..... B23P 17/02

[52] U.S. Cl. ..... 29/421.1; 72/58; 72/62; 29/33 R; 29/33 D; 29/33 T

[58] Field of Search ..... 29/421.1, 421.2, 29/33 R, 33 D, 33 T, 897.2; 72/58, 61, 62

[56] References Cited

U.S. PATENT DOCUMENTS

| | | |
|---|---|---|
| Re. 30,802 | 11/1981 | Rogers, Jr. . |
| 1,417,944 | 5/1922 | Ryder . |
| 1,943,560 | 1/1934 | Squires . |
| 2,047,296 | 7/1936 | Squires . |
| 2,458,854 | 1/1949 | Hull et al. . |
| 2,837,810 | 6/1958 | Ekholm . |
| 4,238,878 | 12/1980 | Stamm et al. . |
| 4,305,269 | 12/1981 | Kimura . |
| 4,393,674 | 7/1983 | Rasmussen . |
| 4,460,200 | 7/1984 | Rasmussen . |
| 4,502,308 | 3/1985 | Kelly . |
| 4,567,743 | 2/1986 | Cudini . |
| 4,730,474 | 3/1988 | Iwakura et al. . |
| 4,744,237 | 5/1988 | Cudini . |
| 5,070,717 | 12/1991 | Boyd et al. . |
| 5,233,854 | 8/1993 | Bowman et al. . |

(List continued on next page.)

FOREIGN PATENT DOCUMENTS

| | | |
|---|---|---|
| 1139807 | 11/1962 | Germany . |
| 57-165134 | 10/1982 | Japan . |
| 385146 | 3/1965 | Switzerland . |

OTHER PUBLICATIONS

Patent Abstracts of Japan JP 63 220929A (Mazda Motor Corp.) Sep. 14, 1988.

Ogura, T. et al, "Ube die Anwendung eines hydrualischen Ausbauchverfahrens" Industrie Anzeiger, Essen, 88 Jg. Nr. 48, Jun. 17, 1966, pp. 1001 to 1004.

Ogura, T. et al, "Liquid Bulge Forming", Metalworking Production, Apr. 24, 1968, pp. 73–81.

Ueda, T. "Differential gear casings for automobiles by liquid bulge forming processes" Parts 1 and 2 Sheet Metal Industries Mar. 1983, pp. 181–185 and Apr. 1983 pp. 220–224.

*Primary Examiner*—S. Thomas Hughes
*Assistant Examiner*—Steven A Blount
*Attorney, Agent, or Firm*—Ridout & Maybee

[57] ABSTRACT

A frame member of rectangular cross section with rounded corners is formed by expansion of a tubular blank within a die cavity having an inner portion of corresponding cross section and an outer transition portion which is of smoothly continuously curved cross sectional profile elongated substantially parallel to the larger dimension of the rectangular section. An outer portion of the tubular blank is deformed to correspond with the continuously curved cross sectional profile and is sealed by a resiliently compressible sealing element of corresponding profile through which fluid pressure is applied in order to expand the blank. By matching the profile of the transition portion to the rectangular inner portion, the transition portion can be made shorter and considerable savings of materials and resources can be achieved.

22 Claims, 11 Drawing Sheets

U.S. PATENT DOCUMENTS 5,233,856 8/1993 Shimanovski et al. .
5,235,836 8/1993 Klages et al. .
5,239,852 8/1993 Roper .
5,321,964 6/1994 Shimanowski et al. .
5,363,544 11/1994 Wells et al. .
5,475,911 12/1995 Wells et al. .
5,644,829 7/1997 Mason et al. .

METHOD FOR EXPANSION FORMING OF TUBING

This application is a continuation of application Ser. No. 08/808,934 filed Feb. 28, 1997 (now U.S. Pat. No. 5,815,901) which is a continuation of application Ser. No. 08/567,721 filed Dec. 5, 1995 (now U.S. Pat. No. 5,644,829) which is a continuation of Ser. No. 08/106,752 filed Aug. 16, 1993 (now abandoned).

BACKGROUND OF THE INVENTION

The invention relates to a method and apparatus for expansion forming of tubing.

Various methods for expansion forming of tubing are known. For example, it is known to form frame members by pressurizing and expanding a tubular blank within a die cavity having a rectangular cross-section with rounded corners corresponding to the cross-section of the final frame member. This allows frame members to be produced with very accurate dimensions at high speed and at relatively low cost. Preferably, the expansion of the circumference of the blank is less than about 5%, so that frame members of excellent strength properties can be obtained using, for example, starting material tubular blanks of ordinary grades of steel. Commonly assigned U.S. Pat. No. 4,567,743 dated Feb. 4, 1986 and Re. 33990 dated Jul. 14, 1992, each in the name I. G. Cudini, disclose techniques for allowing a blank to be confined without pinching in a die having its die cavity circumference exceeding the circumference of the blank by no more than about 5%.

Various methods may be employed for sealing an end of a tubular blank to allow the interior to be pressurized. U.S. Pat. No. 2,837,810 in the name Ekholm, for example, discloses a circular plug having a resilient annular sealing element which is inserted inside one end of a tube to be expanded within a die, and the annular sealing element is compressed to seal on the inner circumference of the tube.

Copending and commonly assigned U.S. patent application Ser. No. 07/860,553 filed Mar. 30, 1992 (now U.S. Pat. No. 5,525,836) discloses tube sealing means having an elastomeric sealing element compressible between ring members to radially expand the sealing element into sealing engagement with the tube from a normal or relaxed position in which it is normally nested inwardly between the ring members. When such sealing arrangements are used for the expansion of tubes to form them into, for example, frame members having a rectangular or other elongated cross-section, it is necessary to provide a transition portion between the tube end receiving the sealing element and the inner elongated cross section portion. Applicant has found that if the angle of inclination of the wall of the transition portion relative to the tube axis is made too great, the transition portion tends to wrinkle longitudinally. The wrinkling tends to extend to the expansion formed portion and is not removed by the pressures ordinarily used for expansion and can render the frame member or other product unusable. As a result, with the known method, for a given starting material tube and a desired final product of, for example, rectangular section having given dimensions it is necessary to provide a transition portion of a certain minimum length. Since in many cases a frame member wholly of certain cross sections is desired, it is usually necessary to cut off the transition portion. With the known methods, the excessive length of the transition portions results in considerable waste of materials and resources.

SUMMARY OF THE INVENTION

In the present invention, before confining a blank within a die having a cavity corresponding to the desired final expanded member, an end of the tubular blank is deformed to provide it with a cross-section of continuously smoothly curved elongated profile. The blank is sealed by applying a sealing member of corresponding profile and the blank is pressurized after sealing to expand it Within the confines of the die cavity. The pressure is then released, the sealing member removed and the expanded blank is withdrawn from the die.

By providing the sealed end of the blank and the sealing element with an elongated cross-section the profile of the sealed end can be made to match more closely the profile of the final expanded blank and as a result a much shorter transition portion may be employed so that there is considerably less wastage of materials and resources.

In a preferred form, a transition portion of the cavity has a cross section that varies continuously smoothly between an elongated cross-section of an inner cavity portion and the cross section of the said deformed end, and the deformed end is elongated in a direction substantially parallel to the direction of elongation of the cross-section of the inner cavity portion.

Preferably, in order to achieve excellent strength properties for the frame member, a blank is used of circumference such that forming it to the shape of the final frame member results in expansion of the circumference of the blank by no more than about 5%.

The method of the invention may be used to advantage when the sealing portion is applied to the outside of the wall of the end of the tubular blank or is applied to the inside of the wall.

One preferred form of apparatus for expansion forming of tubular members, in accordance with a further aspect of the invention, comprises:

(a) die sections movable from an open position, in which a tubular blank to be formed may be placed between said open die sections, through an intermediate position wherein said die sections partially close together, to a closed position wherein said-die sections define between them a die cavity wherein said tubular member may be expansion formed, said cavity opening to at least one end of said die sections;

(b) an auxiliary clamp member mounted on said at least one end of one die section through a lost motion linkage, and biased to a normal position extended relative to said one die section in the direction of die closure and engaging an end portion of the tubular blank to locate the blank relative to the or each other die section before said one die section contacts the blank on closure from said open to said intermediate position and retracting from the normal position relative to said one die section, in a direction opposite to the direction of die closure against the action of the biasing means, as said die sections move from the intermediate to the closed position;

(c) a sealing member having a resilient sealing portion of continuously smoothly curved cross-sectional profile corresponding to said throat cavity profile reciprocable into and out of sealing engagement within said deformed end; and (d) means for applying hydraulic pressure internally with respect to said sealing portion whereby the blank may be pressurized and expanded to conform with said die cavity.

In the preferred form of apparatus for carrying out the method of the invention, said cross-sectional profile of the throat cavity is elongated and the auxiliary clamp member cooperates with the or each other die section in the intermediate position to deform the end of the blank to the said elongated profile.

BRIEF DESCRIPTION OF THE DRAWINGS

Some preferred embodiments of methods in accordance with the invention will now be described, by way of example only, with reference to the accompanying drawings.

DETAILED DESCRIPTION OF THE INVENTION

Figure 1:
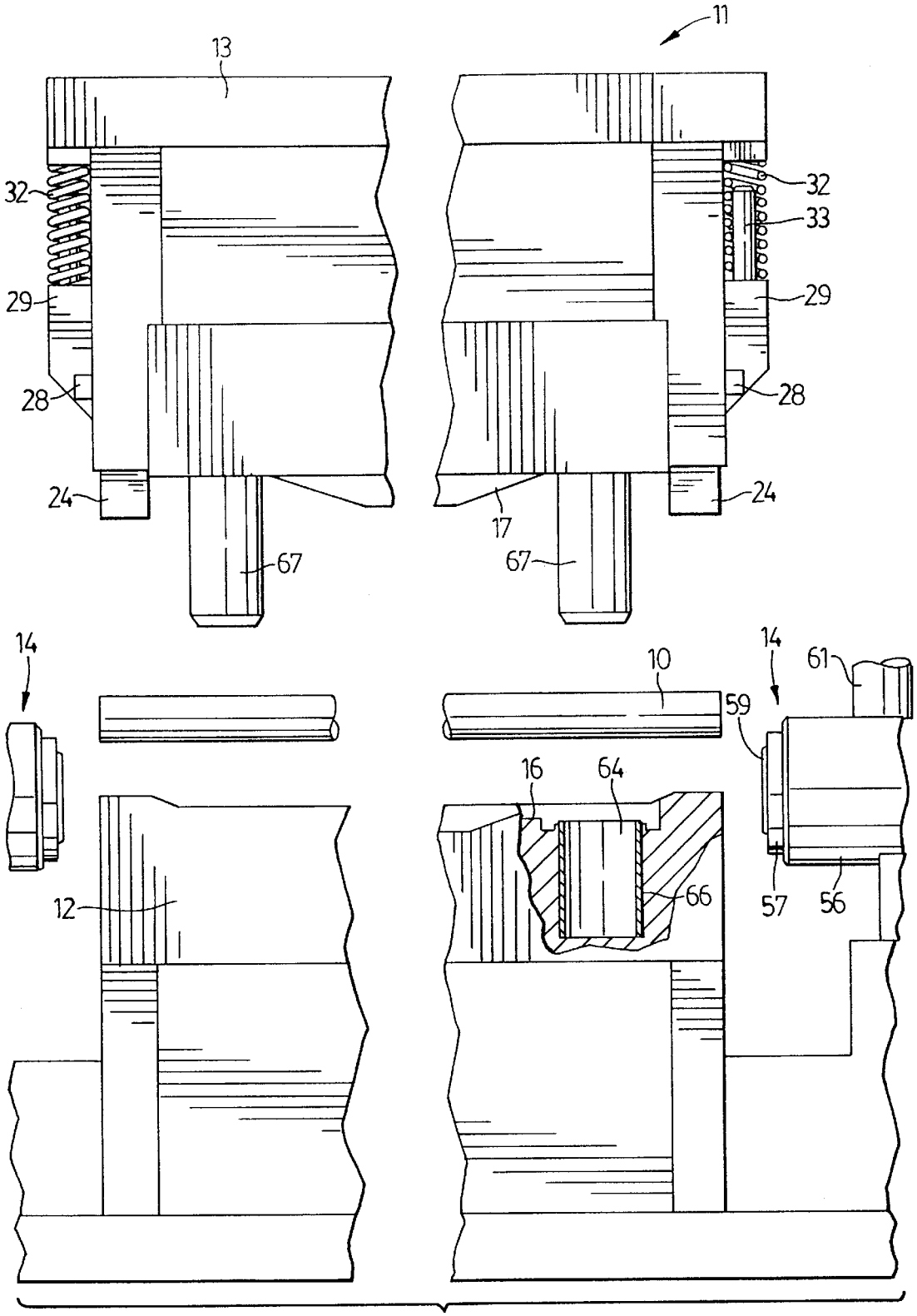
FIG. 1 is a side view partly in section of one form of process apparatus for use in expansion forming in accordance with the present invention.

Referring to the drawings wherein like numerals indicate like parts, FIG. 1 shows one preferred form of tube expansion apparatus for use in expansion forming carried out on a tubular, preferably circular blank 10. The apparatus comprises a press 11 having a lower, usually fixed portion 12 and an upper portion 13 movable vertically relative to the lower portion 12. Seal heads 14 are provided at each end of the apparatus for sealing it-le ends of the blank 10 and conducting pressurized liquid to and from the interior of the blank 10. The portions 12 and 13 carry respective lower and upper die cavity portions 16 and 17 which when closed together around the tubular blank 10 form an open-ended die cavity defining the desired shape of the final frame member or other product to be produced by expansion-forming.

The apparatus illustrated is adapted to employ the highly advantageous expansion-forming techniques described in U.S. reissue patent Re 33990 wherein, before closing the die cavity portions 16 and 17 together, the blank 16 is pressurized internally with liquid to a pressure less than the yield limit of the wall of the blank. Subsequently, after closure of the die sections 16 and 17 together, the pressure is increased to above the yield limit of the wall of the blank, so that it expands into perfect conformity with the die cavity. This technique allows high speed forming of high quality, high strength expanded tubular members from inexpensive tube stock materials, as described in more detail in the above Re 33990 patent, the disclosures of which are incorporated herein by reference.

Secondly, the apparatus as illustrated utilizes seal heads 14 similar in many respects to those disclosed in copending U.S. patent application Ser. No. 07/860,553 filed Mar. 30, 1992 (now U.S. Pat. No. 5,235,836), the disclosures of which are incorporated herein by reference. In accordance with the present invention, however, the sealing elements of the seal heads are provided with a resilient sealing portion of continuously smoothly curved cross sectional profile elongated in a direction corresponding to a direction of elongation of a cross sectional portion of the desired product adjacent its ends.

It may be noted that a presently preferred form of filling, sealing and pressurization apparatus is described in commonly-assigned copending patent application Ser. No. 08/106,751 filed Aug. 16, 1993 (now U.S. Pat. No. 5,445,002) in the name Cudini et al, identified by applicants' agent's docket No. TIVAR/63A/1334, the disclosures of which we incorporated herein by reference.

Figure 2:
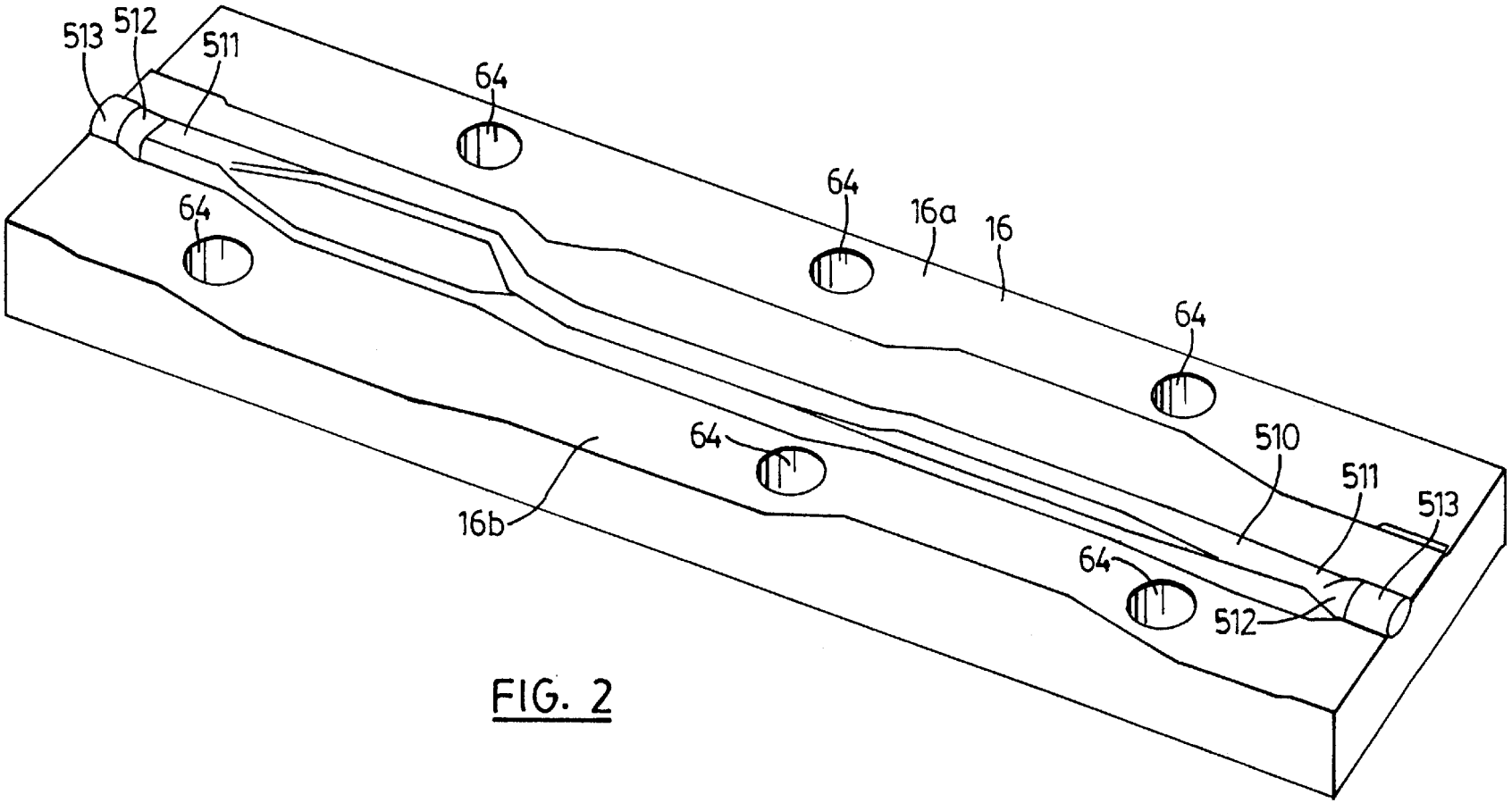
FIG. 2 is a perspective view of a lower die section of the press of FIG. 1 and a finished expanded frame member lying on the die section.

Referring to FIGS. 2 and 4 to 7, the lower die section 16 is shown in more detail. The shape of the die cavity formed when sections 16 and 17 close together may best be described with reference to a final frame member or other product to be formed by expansion forming of the tubular blank 10. Such final frame member 510 is shown in FIG. 2 lying on the lower section 16 ready for removal on completion of the forming cycle. It may be noted that, adjacent each end, the member 510 has a portion 511 that is substantially rectangular with rounded corners. The member 510 is not linear but is bent and twisted so that portions of the member 510 intermediate the portions 511 are similarly generally rectangular although displaced rotationally, and somewhat laterally or vertically with respect to the portions 511. Outwardly from each portion 511, the member comprises a transition portion 512 and an outer end portion 513 which is of continuously smoothly curved cross sectional profile elongated in the horizontal directly, parallel to the direction of elongation of the rectangular portion 511. As shown, the portion 513 is substantially elliptical, but other continuously smoothly curved elongated cross sectional profiles are contemplated for use in the present invention. All portions of the member 510 merge smoothly and continuously with the adjacent portions, so there are no abrupt angularities or discontinuities. In particular, transition portion 510 tapers and merges smoothly from portion 511 to outer end portion 513.

Figure 4:
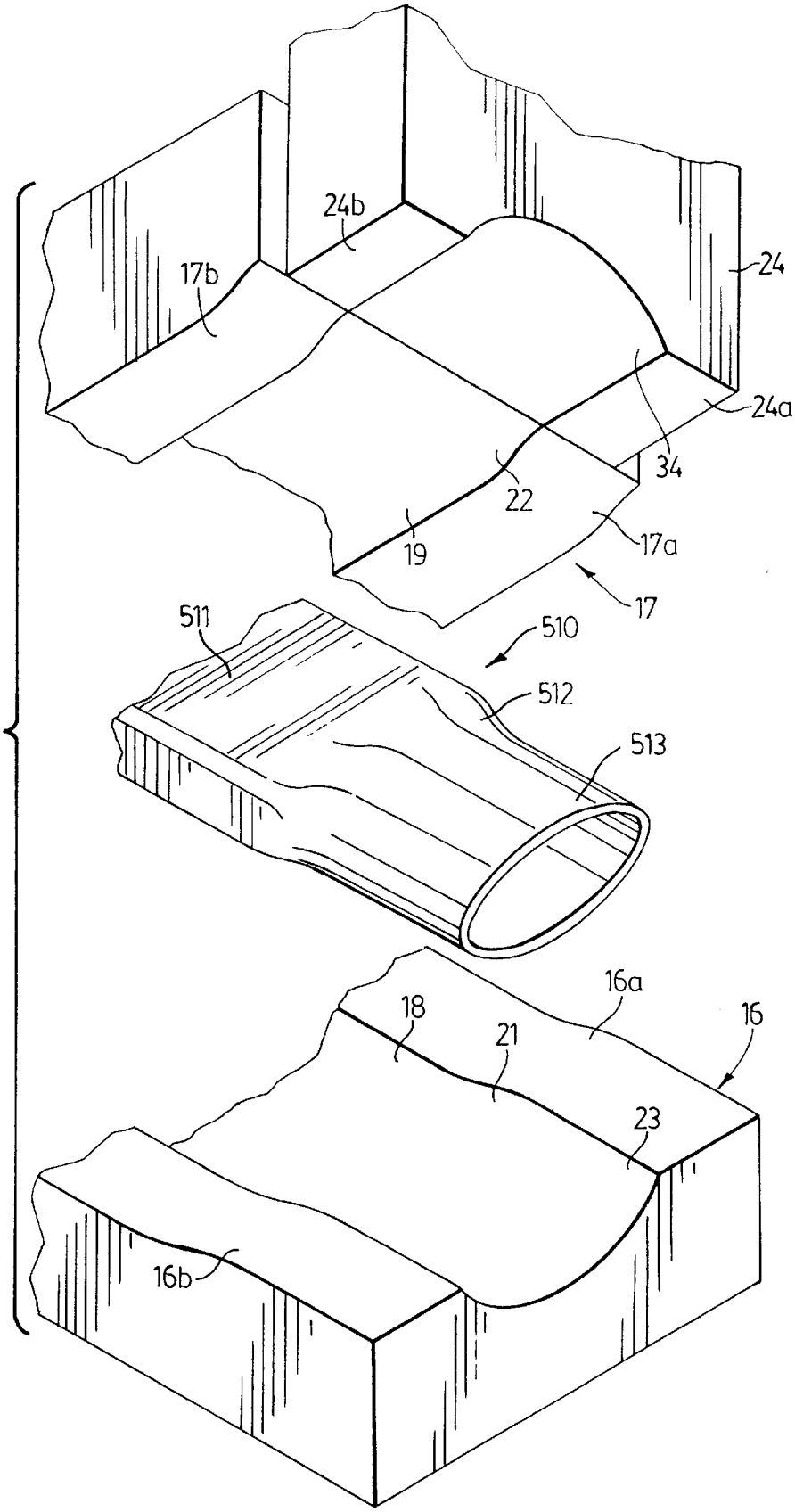
FIG. 4 is a somewhat schematic partial isometric view of one end of the upper and lower die sections of the apparatus of FIG. 1 and of the finished frame member.

The upper and lower die sections 16 and 17 are provided with internal and transitional die cavity portions such that, when the sections 16 and 17 close together and the mating surface portions 16*a* and 16*b* of the lower die section 16 engage the corresponding mating surface portions 17*a* and 17*b* of the upper die section 17, they define together a cavity open at each end and having the shape of the desired final product 510 together with the transition portions 512 and end portions 513 which are normally cut off and discarded after completion of the forming cycle. Referring to FIG. 4, a portion of such internal cavity portions 18 of the lower die and 19 of the upper die is shown, together with transition cavity portions 21 for the lower die sections 16 and 22 for the upper die sections 17 are shown. In addition, the lower, normally fixed die section 16 is provided with a throat cavity portion 23 of semi-elliptical cross section, or other cross section matching the desired profile of the outer end portion 513.

Figure 3:
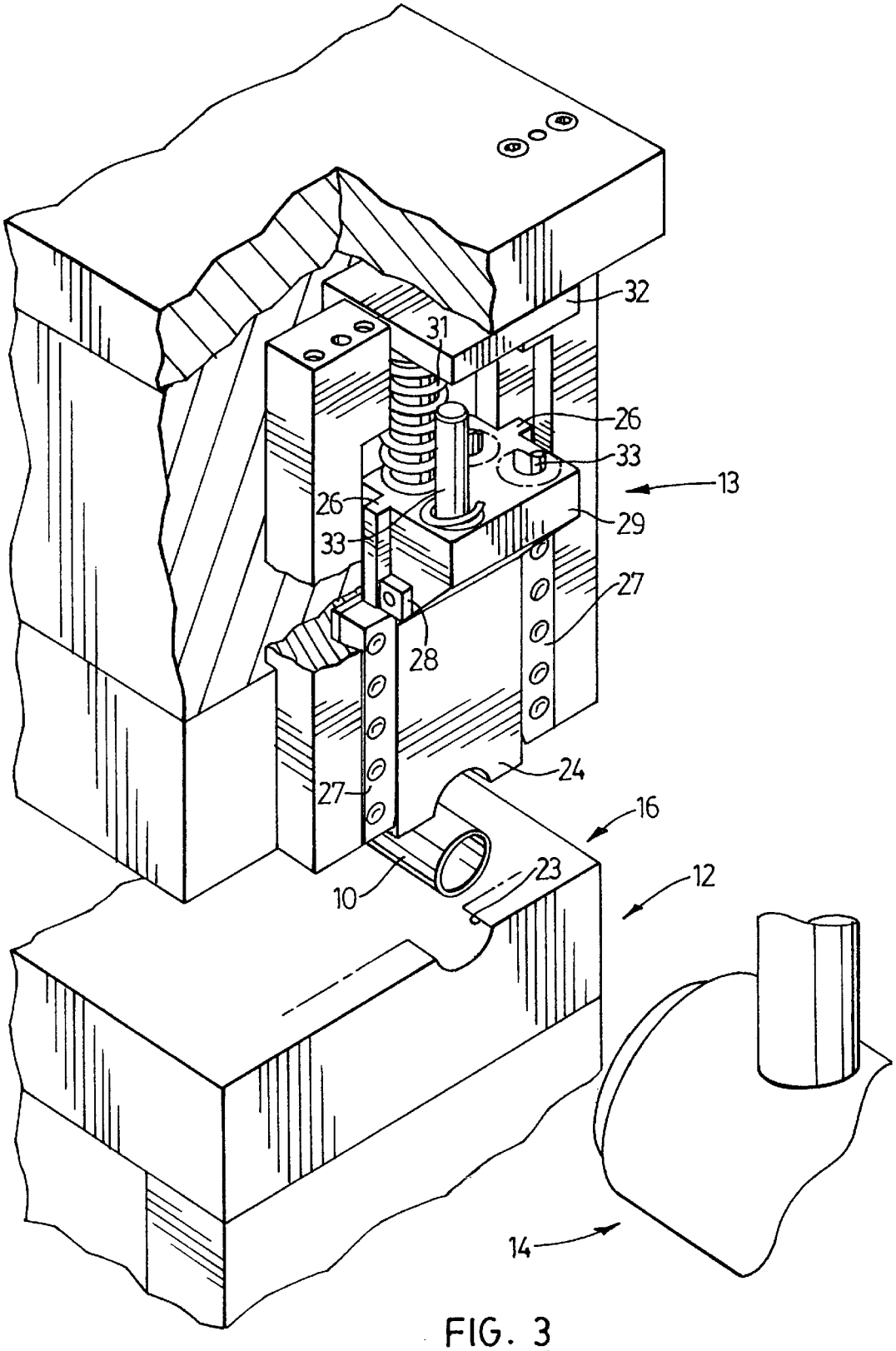
FIG. 3 is a partial perspective view, partly in section of one end of the apparatus of FIG. 1.

At each end of the upper portion 17, in a position cooperating with the lower throat cavity portion 23, a vertically sliding clamp member 24 is connected to the upper portion 13 through a lost motion linkage. As best seen in FIG. 3, each member 24 has on each lateral flank a vertically extending shoulder 26 slidingly retained within vertical guide structure 27 secured to an end face of the moving portion 13. A stop 28 is connected on each side of an upwardly laterally outwardly extending upper portion 29 of the member 24, and limits downward travel of the member 24 to a normal or extended position relative to the portion 13 to the position shown in FIGS. 1 and 3 wherein the member 24 extends a distance below the upper die section 17 and stop 28 engages an upper end of the guide structure 27. A series of compression springs 31 react between the upper portion 29 and a bearing plate 32 connected to the portion 13. The springs 31 normally maintain the clamp member 24 displaced downwardly relative to the upper die section as seen in FIGS. 1 and 3. Dowels 33 secured to the upper portion 29 locate the compression springs 32.

Figure 9:
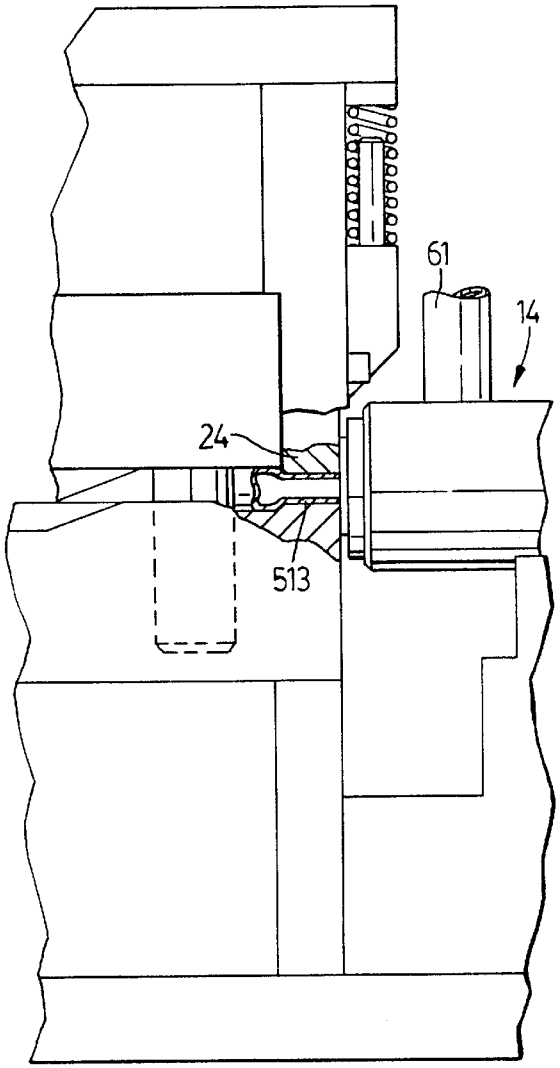
FIGS. 8 and 9 are partial side views, partially in section showing successive stages in the forming process.
Figure 8:
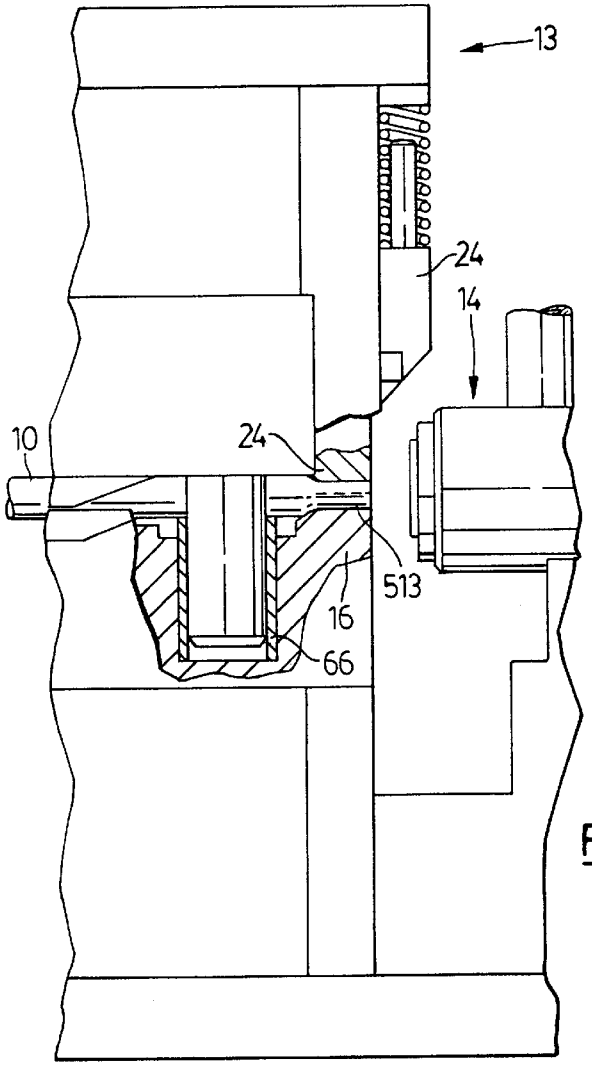

The length of the lower end of each clamp member 24, as seen in side view in FIGS. 1, 8 and 9 is the length of the throat cavity portion 23 of the lower die section 16 and is similarly formed with a recess 34 of semi-elliptical form or other form matching the desired elongated profile of the outer end portion 513.

Figure 7:
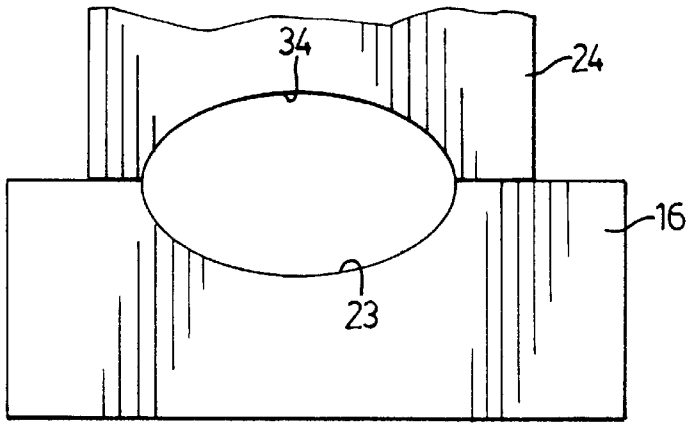
FIG. 7 is a front view of the die taken on the arrow 7 in FIG. 5.
Figure 6:
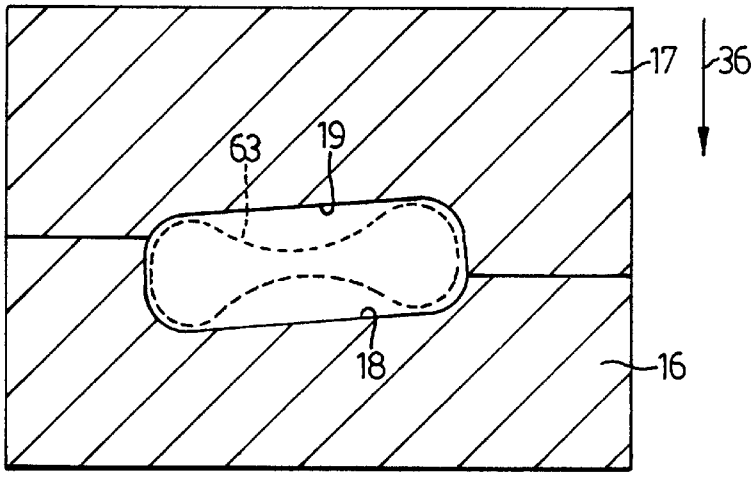
FIG. 6 is a section on the line 6—6 in FIG. 5.
Figure 5:
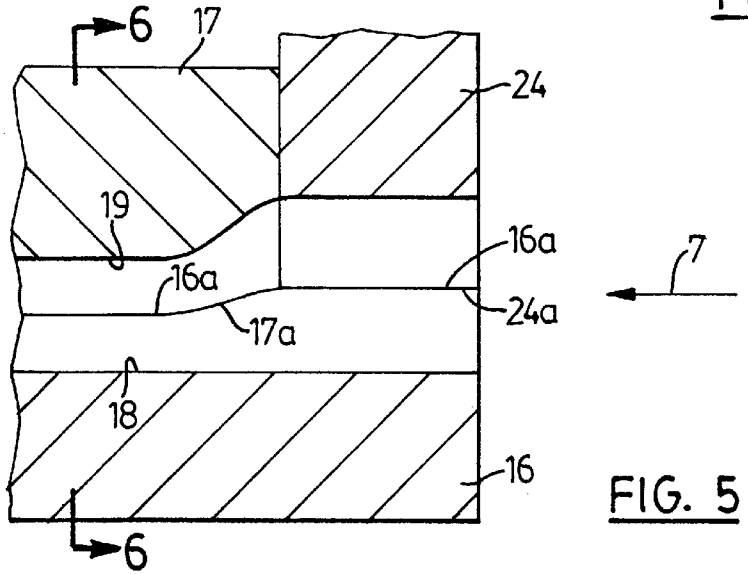
FIG. 5 is a longitudinal section through the die sections of FIG. 4 in closed position.

Referring again to FIG. 2 together with FIGS. 5 to 7, which show upper die sections 17 and clamp member 24 engaged on lower die section 16, an internal cavity portion defined by portion 18 and 19 as seen comprises an axially elongated portion of uniform rectangular cross section with rounded corners matching the portion 511 to be formed therein. In the example illustrated, it is desired to form portion 511 having its sides inclined at a small angle to the directional vector 36, usually vertical, in which the upper and lower die sections 16 and 1.7 move between their open and closed positions. In order to facilitate removal of the product 510 from the die at the end of the forming cycle, and reduce the risk of pinching of the starting material blank when the die sections are closed, preferably the split planes defined by the mating surface portions 16*a*, 16*b*, 17*a* and 17*b* of the die sections 16 and 17 are off-set with respect to one another in the direction of the vector 36. In the example shown, they intersect the sides of the approximately rectangular profile seen in FIG. 6 at approximately points of greatest lateral extension of the cavity portions.

In the preferred form, as shown, the throat cavity portion defined by the cavity portions 23 and 34 when clamp member 24 closes on 16 comprises an axially elongated portion of uniform continuously smoothly curved cross sectional profile elongated at approximately right angles to the vector 26, preferably an ellipse having its major axis substantially parallel to the longest dimension or direction of elongation of the approximately rectangular portion shown in FIG. 6 and the portion 511 formed therein. From FIG. 5, it will be noted that the centre of the elliptical portion is slightly off-set upwardly from the geometric centre of the rectangular portion seen in FIG. 6, so that the lower side of the portion 23 is approximately aligned with the lower side of the portion 18, in order to facilitate design of the die cavity portions. The split planes preferably intersect the major axis of the ellipse to facilitate closure of the die and removal of the final part and therefore incline outwardly as seen in FIG. 5. It will be appreciated, however, that the axis of the elliptical portion defined between the member 24 and the lower die section 16 may, if desired, be aligned with the centre of the rectangular portion seen in FIG. 6.

The transitional die cavity portion defined by portions 21 and 22 varies continuously smoothly from the approximately rectangular cross sectional portion of FIG. 6 to the elliptical portion of FIG. 7, so there are no abrupt changes in profile which would result in concentrations of stress in the metal of the tubular blank during the forming process and which could result in wrinkling, tearing or rupturing of the wall of the blank.

Figure 12:
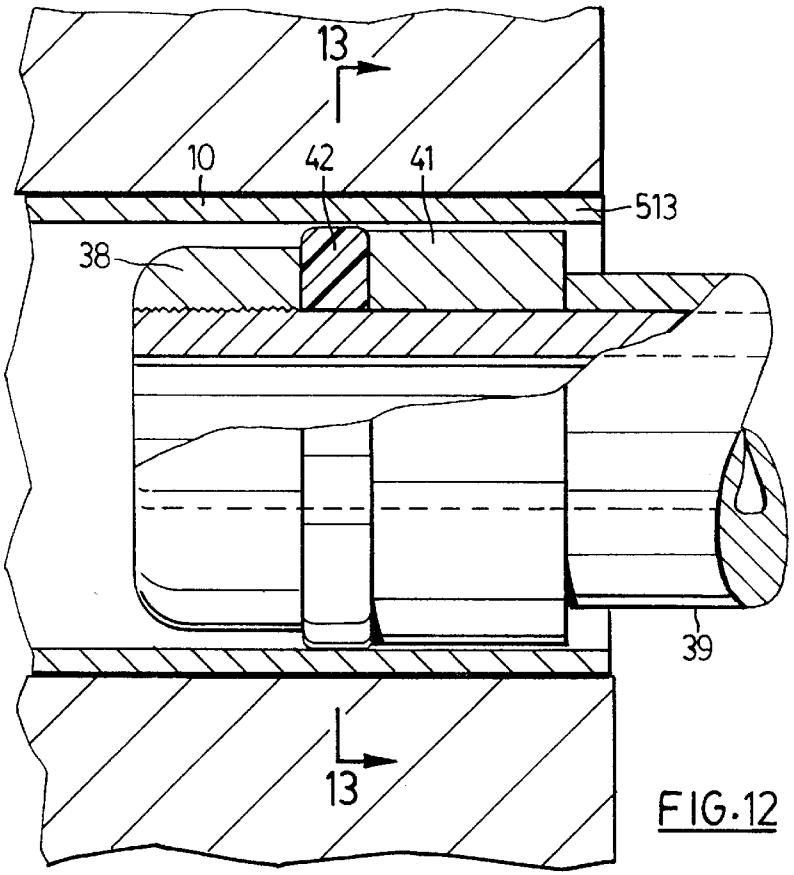
FIGS. 11 and 12 are partial cross sectional views on an enlarged scale showing successive stages in the engagement of a seal head within the tube workpiece.
Figure 13:
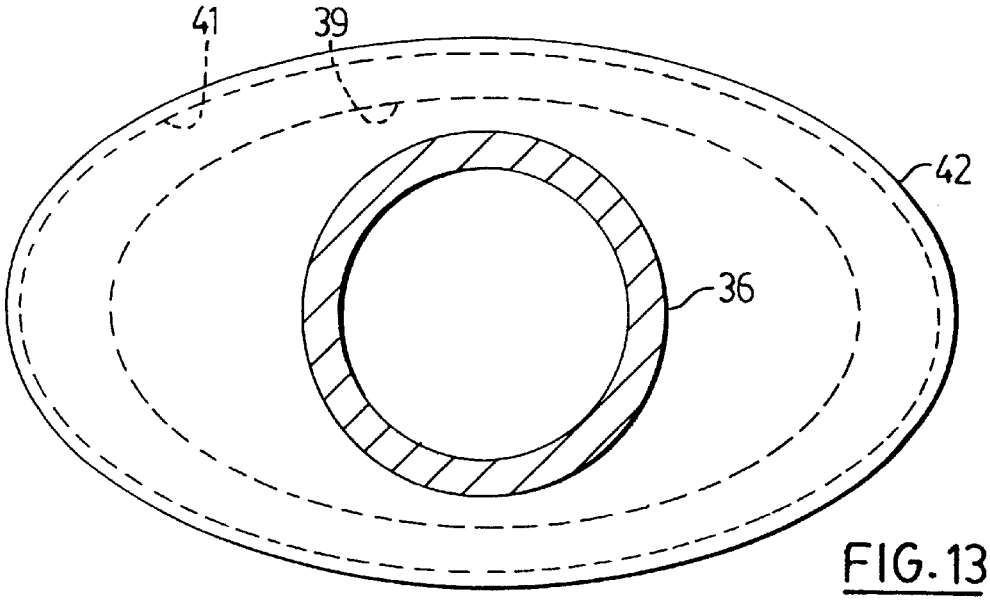
FIG. 13 is a cross section through the elastomeric sealing portion of the seal head taken on the line 13—13 in FIG. 12.

FIGS. 10 to 13 illustrate one form of sealing head 14 which may be employed in/association with the press apparatus 11. The sealing head 14 is generally as. described in the above mentioned related application Serial No. 07/860,553 (U.S. Pat. No. 5,235,836), to which reference may be made for further details. Briefly, each member 14 comprises an internal high pressure sealing portion comprising a hollow shaft 36 which may be elliptical in section or circular as seen in FIG. 13 on the inner end of which a shaft abutment member 38 elliptical in section is fixed. An outer sleeve 39 which is preferably elliptical in section as seen in FIG. 7 is slidable on the outer side of the shaft 36 and a sleeve abutment member 41 elliptical in section is connected on the inner end of the sleeve 39. Between the members 38 and 41 is a resiliently deformable sealing portion 42, for example of a polyurethane elastomer which may be in the form of a body of uniform thickness if the shaft 36 is elliptical or of a varying thickness as seen in FIG. 13.

Figure 10:
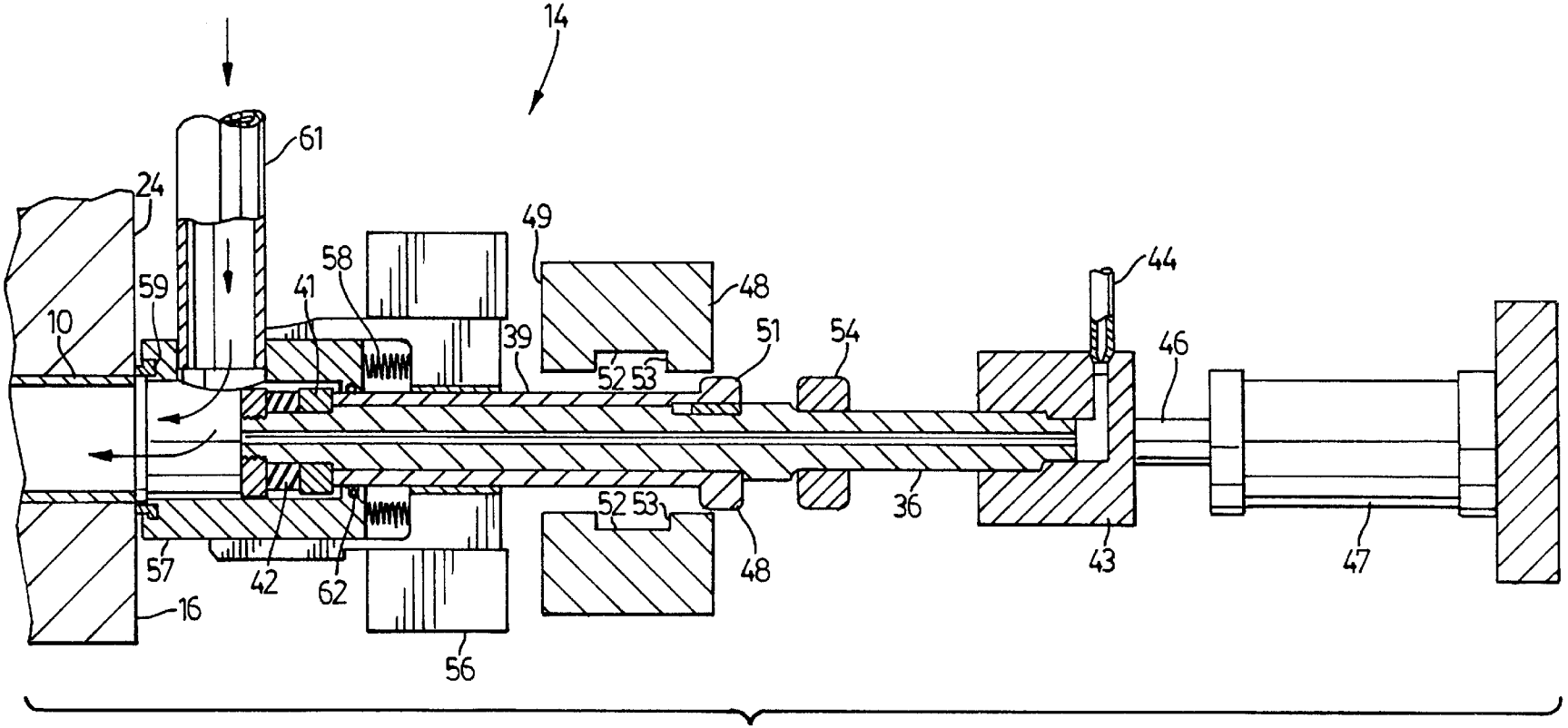
FIG. 10 is a cross section on an enlarged scale corresponding to FIG. 9 and illustrating a sealing member and a low pressure filling operation.
Figure 11:
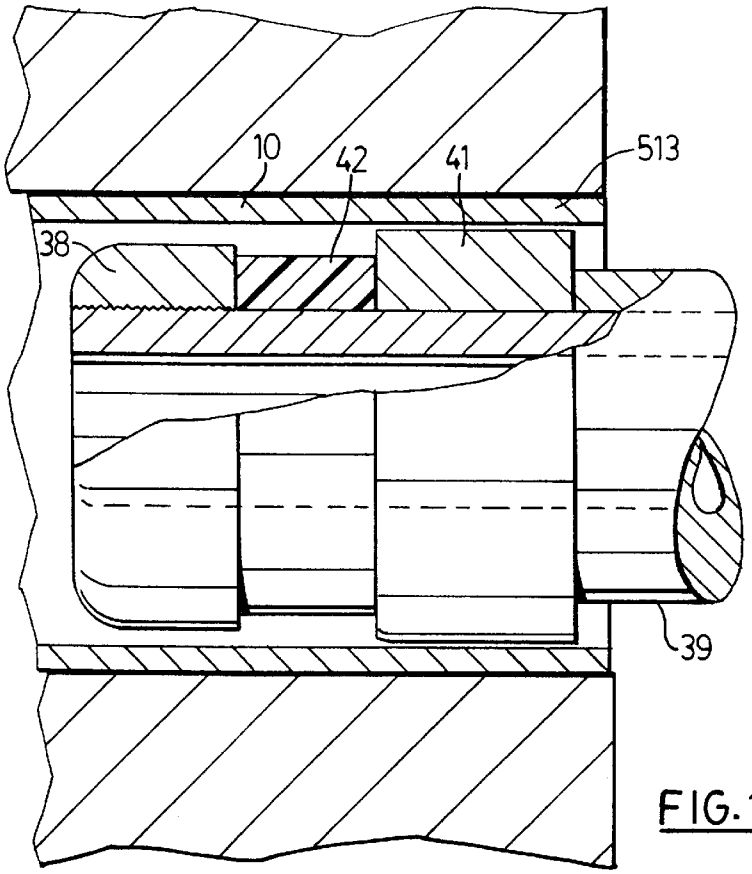

In the preferred form, the portion 42 in the uncompressed or relaxed condition as seen in FIG. 11 is nested inwardly of the members 38 and 41 for protection against cutting, scoring or the like by contact with a sharp end of the blank 10 to be sealed. An outer end of the shaft 36 is connected through a block 43 as seen in FIG. 10 to a line 44 connected through valving to a source of high pressure liquid. The block 43 is connected to a piston rod 46 of a piston working in a cylinder 47 by means of which the shaft 36 can be reciprocated between the retracted position as shown in FIG. 10 and the advanced position as shown in FIG. 11.

Transversely reciprocable stop members 48 are provided each having a forward abutment surface 49 for engagement with an enlarged rear end 51 of sleeve 39. The inner side of each stop member 48 is provided with a recess 52 providing a rear abutment surface 53 for cooperating with a member 54 threaded or otherwise longitudinally adjustably connected on shaft 36 to limit compression applied to the elastomer portion 42.

Adjacent its forward end, the sleeve 39 passes slidably through a support 56 on which a cylindrical shroud 57 is connected reciprocably. Compression springs 58 acting between the shroud 57 and the support 56 normally urge the shroud 57 forwardly. The forward end of the shroud is provided with forwardly projecting gasketing 59 for sealing on substantially vertical end faces of the lower die section 16 and the clamp member 24, when engaged together in the position shown in FIG. 7. A lower pressure liquid inlet line 61 is connected in one side of the shroud 57 and connects through valving to a pump or other source of liquid capable of delivering liquid at a high volume flow rate under low pressure. An O-ring 62 seals between the shroud 57 and sleeve 39 at the point where the latter enters the rear of the shroud 57. Normally, in a retracted condition of the piston rod 46, the sleeve abutment member 41 engages an adjacent rear side of the shroud 57 and maintains the shroud 57 in a retracted condition, as seen in FIGS. 1 and 3, against the action of the compression springs 58.

The seal heads 14 at each end of the apparatus as seen in FIG. 1 are of substantially similar construction.

In use, with the die portions 12 and 13 in the open position, a circular section blank 10 is laid on the bottom die section 16. Usually, the blank 10 is bent or non-linear to conform to a bent or non-linear shape desired for the final product 510. The procedures that may be used for bending the blank are well known to those skilled if the art and need not be described in detail herein. The portions 12 and 13 are then closed in the direction of the vector 36 to an intermediate position wherein there is a small spacing between the pairs-of mating surface portions 16*a*, 16*b* and 17*a* and 17*b*. Due to the extension of the clamp members 24 relative to the die section 17, the members 24 engage on the ends of the blank 10 before the die section 17 contacts the blank 10 and tend to be shifted upwardly against the action of the compression springs 31 relative to the upper portion 13. The spring rate of the compression springs 32 is such that the resilient reaction provided by the springs 32 is sufficient to clamp the end portions of the blank on the lower die section 16 and to deform the outer end portions of the blank 10 to provide them with the deformed end portions 513 discussed above.

One function of the clamp members 24 is therefore to provide the ends of the blank with the deformed ends elongated substantially in the direction of elongation of the adjacent elongated portions 511. Secondly, the clamp portions locate or retain the bent blank 10 in fixed position on the die section 16. As the die sections 16 and 17 close toward the intermediate position, the blank 10 reacts with inclining surfaces of the die sections 16 and 17 and, if the blank were unrestrained, there would tend to be uncontrolled displacement of the blank relative to the die sections 16 and 17. The clamp members 24 retain the blank 10 so that its ends are retained in a position aligned with the seal heads 14 in a position to receive the sleeve 39 and shaft 36 when extended in the direction of their axes. Further, the clamp members 24 retain the blank 10 so that it is compressed and deformed in controlled fashion between the die sections 16 and 17 as they close to the intermediate position. In the intermediate position, the mating surface portions 24*a* and 24*b* at each end mate on the upper side of the mating portions 16*a* and 16*b* of the lower die section, as seen in FIG. 8. The small spacing above referred to is preferably about 10 to about 25%, for example about 14% of the diameter of the cylindrical tubular blank 10. The compression of the blank 10 between the die sections 16 and 17 in its intermediate portions may tend to deform intermediate portions, where these are engaged between die cavity portions forming transversely elongated approximately rectangular profiles into approximately hour glass section portions, as shown in broken lines at 63 in FIG. 6.

While the blank is held tightly gripped between the sections 16, 17 and between the clamp members 24 and the section 16, piston 46 is extended to the position shown in FIG. 10 wherein the springs 58 urge the shroud member 57 forwardly so that its gasket 59 seals against the end faces of member 24 and section 16 as also seen in FIG. 9. Low pressure liquid is then admitted through line 61 at a high volume flow rate to quickly fill the blank 10 with liquid. At this point, the corresponding low pressure line 61 at the sealing head 14 at the opposite end of the blank 10 may be connected to vent to the atmosphere through operation of the valving connected to it.

Once the blank 10 is filled with liquid, the valving is operated to close the vent and to close the line 61 through which the blank 10 was filled with low pressure liquid. The piston 46 in the seal head at each end is then extended to move the shaft 36 from the position of FIG. 10 to the positions shown in FIG. 11 wherein the shafts 36 enter the deformed end portions 513. At this position, the members 51 on the inner side of the abutment surfaces 49, while the member 54 is located within the recesses 52. The stop members 48 are then closed laterally inwardly, and the piston 46 together with the shaft 36 retracted to the position seen in FIG. 12. Engagement of the member 51 on the abutment surfaces 49 limits rearward movement of the sleeve 39 and sleeve abutment member 41 to the position shown in FIG. 12. The shaft 36 together with the shaft abutment member 38 retract to a limit determined by engagement of the member 54 on the rear surfaces 53 of the recesses 52 within the stop members 48 so that the sealing portion 42 is compressed and expands radially outwardly as seen in FIG. 12 to seal tightly on the inner side of the deformed end portion 513 of the blank 10. Liquid is then pumped through the line 44, at one or the other of the seal heads 14, which is in communication with the sealed interior of the blank through the hollow bore in the shaft 36 to pre-pressurize the interior of the blank sufficiently to prevent the wall of the blank 10 extending outwardly beyond the envelope of the die cavity formed between the die sections 16 and 17 when fully closed together, as described in more detail in the above mentioned U.S. reissue patent Re 33990. During the pre-pressurization, the blank 10 is gripped and clamped tightly between the die sections 16 and 17 so that any tendency for bent blanks 10 to straighten out as a result of the internal pressurization is resisted. Typically, this pre-pressurization is about 300 to about 1000 psi. This pressurization is below the yield limit of the wall 10 of the blank.

It may be noted that a further function of the clamp members 24 is to resist outward deformation of the wall of the deformed end 513 of the blank 10 under the pressure exerted by the expanding sealing portion 42, to avoid bulging which may result in leaks of liquid from the blank 10 and loss of pressurization.

Figure 14:
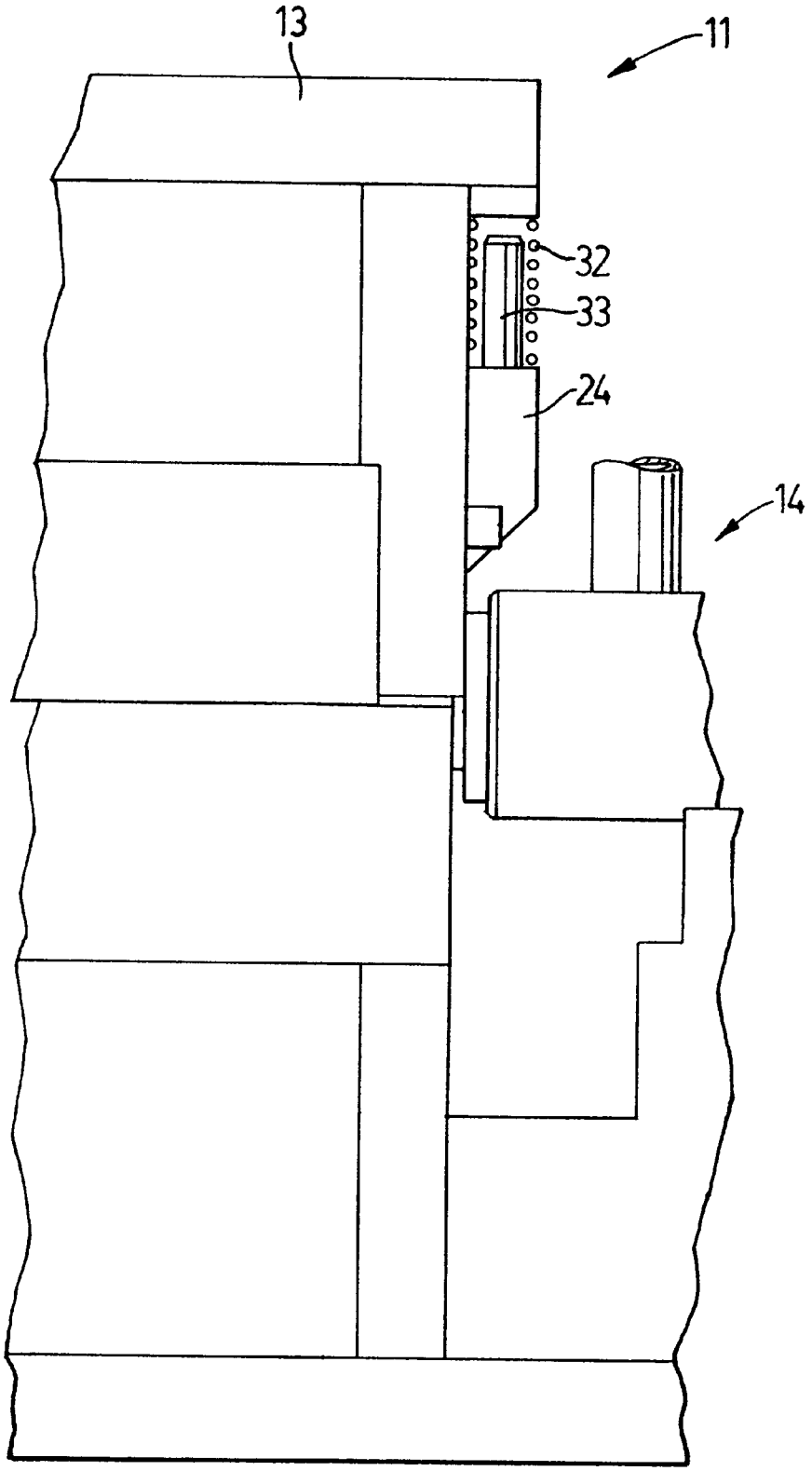
FIG. 14 is a side view of the press shown in FIGS. 8 and 9 in a later stage in the forming process.

The sections 12 and 13 are then moved to a fully closed position, indicated in FIG. 14. In this position, the mating surfaces 16*a* and 16*b* and 17*a* and 17*b* of the lower and upper sections 16 and 17 close fully together. The clamp member 24 is urged further upwardly relative to the upper portion 13 against the action of the compression springs 32 while its lower surfaces 24*a* and 24*b* remain in contact wit-h the upper side of the die section 16. Before full closing of the die sections 16 and 17 together, the or each inlet line 44 may be connected to relief valving to avoid the compression of the blank 10 during the closing movement resulting in pressures internally of the blank which may exceed the yield limit. Once the die sections 16 and 17 are fully closed together, the or each line 44 may be disconnected from the relief valve and one or both of them is connected to a source of high pressurization, so that sufficient pressurization is applied to the liquid in the interior of the blank 10 to cause it to exceed the yield limit of the wall of the blank 10, so that the wall commences to permanently swell or expand radially outwardly until the blank is formed into a product 510 in full conformity with the die cavity formed between the die sections 16 and 17. This full pressurization is accompanied by a small flow of liquid in through the line 44. It may be noted a further function of the clamp members 24 is to withstand the forces exerted on the end 513 of the blank adjacent the sealing portion 42 during full pressurization so that leakage of liquid and depressurization does not occur. The spring rates of the springs 32 should, of course, be sufficient to enable all the above-noted functions.

The pressurization of the liquid on the inside of the blank 510 is then relieved, the stop members 48 opened outwardly to the position shown in FIG. 10, and the piston retracted to the position shown in FIG. 10 allowing draining of the interior of the blank 10 through one low pressure line 61, while the other may be connected to the atmosphere or to blower to allow air to displace the liquid within the blank. The piston 46 is then retracted further, to retract the shroud 57 away from the ends of the clamp members 24 and lower die section 16, and the press open fully to the position of FIG. 1 to allow removal of the fully formed part 510 from between the portions 12 and 13.

The above cycle of operation may then be repeated, commencing with placing of a fresh tubular blank 10 to be formed between the portions 12 and 13.

The above cycle of operation may proceed very rapidly, so that high rates of production are possible.

It may be noted that, in the preferred form, the lower die section 16 is provided with a number of bores 64 lined with bushings 66 and offset laterally and preferably staggered longitudinally on each side of the die cavity in the section 16. The upper die section 17 is provided with corresponding dowels 67 which enter the bushings 66 as the sections move from the open to the intermediate positions, and resist forces tending to deflect the lower and upper sections 16 and 17 laterally with respect to one another as a result of reaction between the blank 10 and the laterally inclining surfaces of the die cavity portions.

Desirably, the circumference of the starting material blank 10 is such that the circumference of the final product frame member 510 at any point is no greater than about 5% larger than the circumference of the starting material blank 10. At least with the readily available grades of tubular steel, if the blank is expanded in circumference by more than about 5%, there is a tendency for the material of the wall of the blank to excessively weaken or crack. While expansion of the tube circumference of up to about 20% can be tolerated if the metal of the tube 10 is fully annealed, it is preferred to conduct the present method without employing special pretreatments of the material of the blank 10, such as annealing. As will be appreciated, there is a manufacturing tolerance on the nominal outside diameters of the cylindrical tubular blanks and hence also on their nominal circumferences. Such tolerance may typically be in the range about ±0.3% to about +0.6% of the nominal diameter, depending on the nominal diameter of the blank. In the preferred form, in order to provide products 510 which are of uniformly accurate dimensions, and which eliminate the manufacturing tolerances of the starting material blanks, and in order to impart to the blank desired cross-sectional profiles without introducing points of weakness or cracking, the product 510 is formed, at all cross-sections, with a profile with a circumference which is uniform, and is slightly larger than the starting blank plus its maximum tolerance. For example, the product 510 may typically be expanded up to about 0.4 to about 2% larger than the nominal circumference of the blank. All references to percentage expansions herein are based on the nominal circumference of the starting material blank 10.

As will be appreciated, the deformation of the end portion 513 of the blank 10 between the clamp members 24 and the corresponding portions of the lower die sections 16 provide the end portion 513 with a smoothly continuously curved cross-sectional profile so that the sealing portion 42 can adapt sealingly to the inner surface of the end portion 513 and the seal can be maintained during the steps of compression, pressurization and expansion of the blank 10. By matching the cross-sectional profile of the elongated end portion 513 to that of the adjacent inner portion 511, the transitional portion 512 may be made relatively short, for example about 60% shorter than transitional portions required when a circular section sealing rather than the elongated profile sealing section member 42 is employed. Since, normally, the portions 512 and 513 of the product. 510 will be cut off in order to provide a final rectangular section product 510, the reduction in length of the transitional portion 512 provides a considerable saving in materials and resources.

As noted above, the direction of elongation of the outer portion 513 need not be exactly aligned with the inner portion 511. Preferably, the respective directions of elongation are within about 20°, more preferably about 10° of one another.

The continuously smoothly curved sealing member 42 need not be, but it preferably is, entirely convex. For example, it may have one or more concave portions and may, for example, be of generally hour glass shape as shown in the member 142 of FIG. 15 wherein reference numerals indicated by 100 indicate parts similar to the sealing member of FIG. 13. It will be noted that the board shaft 36 are replaced by a pair of bored shafts 136 and a pair of sleeves 139 displaceable in the axial direction to compress the sealing portion 142 between an hour glass section sleeve abutment member 141 and a correspondingly shaped shaft abutment member (not seen in FIG. 15).

Figure 15:
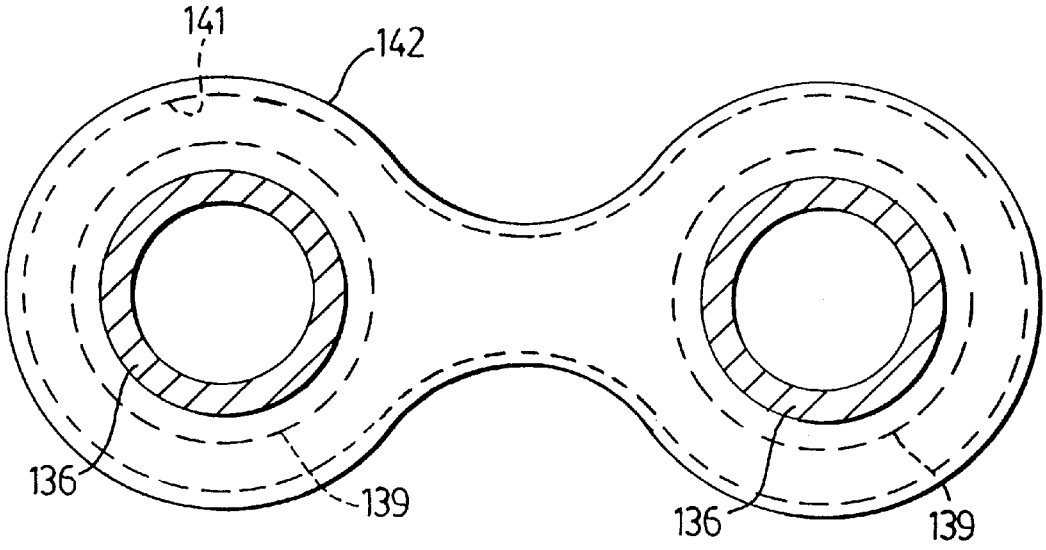
FIG. 15, which appears on the same sheet as FIG. 13, shows an alternative form of sealing element in accordance with the invention.

When using the sealing member 142 shown in FIG. 15, the clamp member cavity portion 34 and the outer throat cavity portion 23 of the lower die section 16 may be formed to define, when closed together a corresponding hour glass section, so that, in the initial stage of closure of the press portions 12 and 13 together, the outer end portion of the tubular blank 10 is formed to an hour glass section instead of the elliptical section 513.

As noted above, preferably the sealing portion 42 and outer throat portion 513 are substantially elliptical. The profile need not conform exactly to a geometrical ellipse, however, and any smoothly rounded generally elongated profile may be employed.

Figure 16:
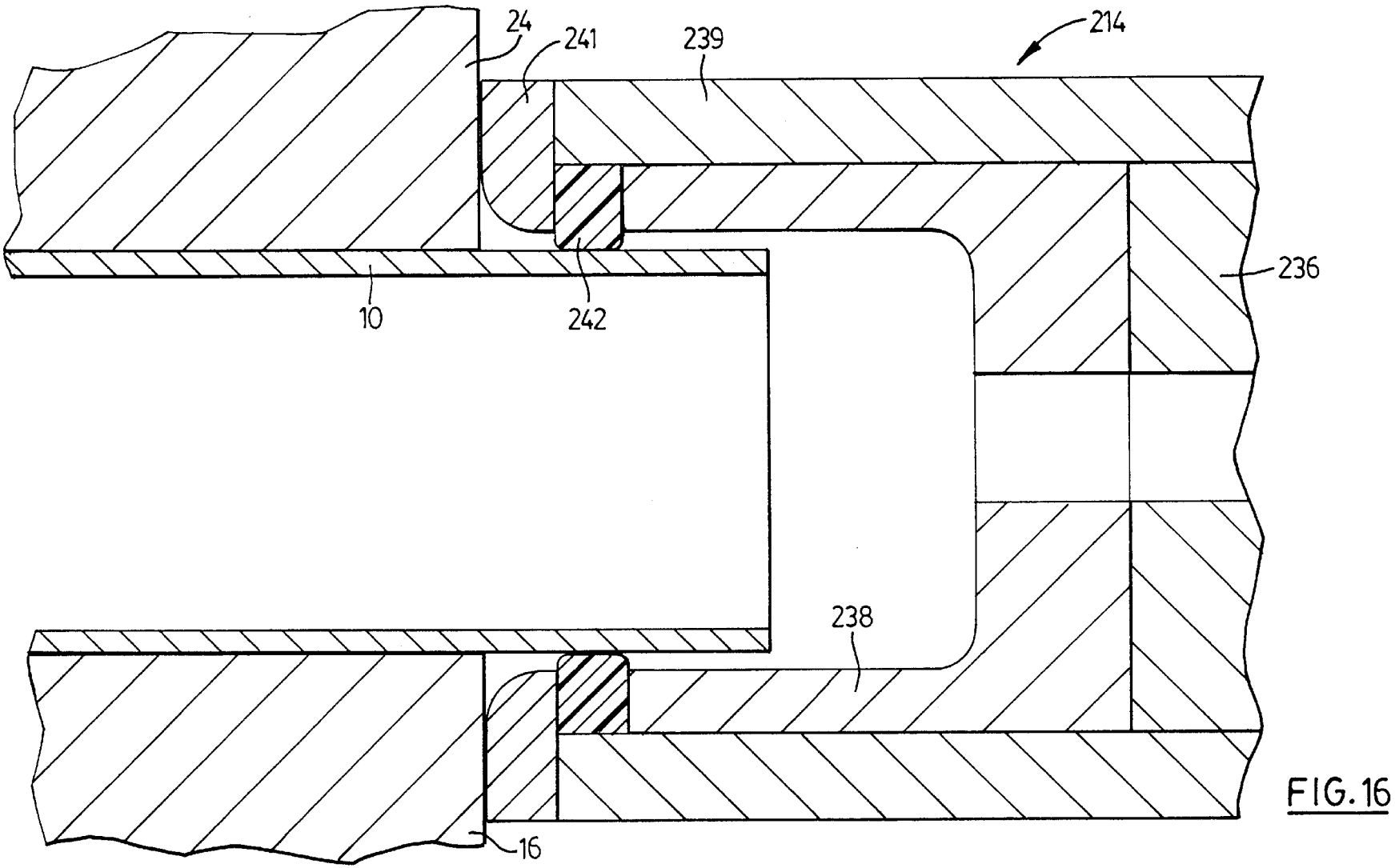
FIG. 16 is a longitudinal cross section corresponding to FIG. 12 wherein external sealing of the tube is employed.

In a further modification, the sealing members 14 may be modified so that the resilient sealing portion is applied on the outside of a tubular blank. In FIG. 16, portions similar to the sealing head 14 are indicated by like reference numerals raised by 200. It is believed the structure and functioning of the sealing member 214 will be readily apparent from FIG. 16 taken together with the detailed description of the internal high pressure sealing arrangement described above with reference to FIGS. 10 to 12. Briefly, it may be noted that retraction of the sleeve 239 and abutment member 241 cause compression of the elastomer portion 242 to cause this to expand radially inwardly to seal on the outer side of the end portion of the blank 10. The outer end may be predeformed in a forming die or the like to form it to a desired elongated cross-sectional profile which matches an adjacent elongated profile of the desired expanded product as well as an elongated cross-sectional profile of the elastomer portion 242. The seal portion 242 may be, for example, substantially elliptical or it may be of other smoothly curved elongated cross-sectional profile, and are disposed substantially parallel to the direction of elongation of an inner die cavity portion defined by the section 16 and 17. A clamp member 24 similar to that described above may initially clamp the end portion of the tubular blank 10 to retain it in position while the sealing member 214 is applied and the blank 10 pressurized.

We claim:

1. A method of forming a tubular member comprising:

(a) providing a die having therein a cavity having a cross section corresponding to a configuration of a desired final tubular member;

(b) providing a tubular blank having thereon an end portion having an initial cross section transverse to the longitudinal axis of the tubular blank;

(c) deforming the end portion of said tubular blank and providing it with a deformed end portion having a deformed cross section transverse to the longitudinal axis of the tubular blank different from said initial cross section, the deformed cross section being a continuously smoothly curved profile;

(d) confining said tubular blank in said cavity;

(e) sealing said blank by applying to said deformed end portion a sealing member having a resilient sealing portion of continuously smoothly curved cross sectional profile corresponding to said deformed cross section;

(f) pressurizing the blank internally to expand it to define the shape of the cavity; and (g) releasing the pressure, removing the sealing member and withdrawing the expanded blank from the die;

and wherein in said step of providing a die, said die comprises die sections moving between open, intermediate and closed positions, each die section having a die cavity portion and a mating surface portion, which die sections in the closed position have the mating surface portion of each section in mating engagement with the mating surface portion of each adjacent section on the die cavity portions defining said cavity, and said step of deforming said end portion of said tubular blank comprises placing the blank between the die sections in the open position, and partially closing the die sections to said intermediate position for deforming said end portion, and wherein said sealing member is inserted into the deformed end before the black is confined in the die by moving said die sections to the closed position.

2. A method as claimed in claim 1 wherein said step of deforming the end portion, said deformed end portion is wholly convex.

3. A method as claimed in claim 2 wherein in said step of deforming the end portion, one of said initial cross section and said profile is substantially an ellipse.

4. A method as claimed in claim 1 wherein in said step of sealing said blank said sealing member comprises first and second longitudinally spaced compression members and said resilient sealing portion disposed between them, and means for urging the compression members toward one another for expanding the sealing portion transversely for resilient engagement on the wall of the blank.

5. A method as claimed in claim 4 wherein the sealing member is applied on the outer side of the blank and the sealing portion expands radially inwardly.

6. A method as claimed in claim 4 wherein the sealing member is applied on the inner side of the blank and the sealing portion expands radially outwardly.

7. A method as claimed in claim 1 wherein in said step of providing a die said die cavity comprises an internal cavity portion having its cross section elongated in a reference direction and outwardly therefrom, a transition portion varying continuously smoothly in cross section from said inner portion to said end portion of said deformed cross section.

8. A method as claimed in claim 1 wherein, in said step of providing a die said internal cavity portion cross section is rectangular with rounded corners.

9. A method as claimed in claim 1 including deforming each end portion of said tubular blank to provide it with said deformed cross section, and applying a sealing member to each deformed end portion, each said sealing member having a resilient sealing portion of continuously smoothly curved cross sectional profile corresponding to its respective deformed end portion.

10. A method as claimed in claim 1 wherein, in said step of providing a die, at least one die section has an auxiliary clamp member connected thereon through a lost motion linkage, said auxiliary clamp member defining with at least one other die section a throat cavity having said continuously smoothly curved deformed cross sectional profile, said auxiliary clamp member being biased toward said other die section and clamping and deforming said one end of the blank on movement of the said one die section from the open to said intermediate position, and retracting relative to said one die section and remaining substantially stationary relative to said other die section on movement of said die section from the intermediate to the closed position.

11. A method as claimed in claim 10 wherein said auxiliary clamp member clamps said one end of the blank before said one die section contacts the blank.

12. A method as claimed in claim 10 wherein before the die sections are moved from the intermediate to the closed position, th e blank is pressurized to a first pressure insufficient to exceed the elastic limit of the wall of the blank and sufficient to avoid pinching of the blank between said mating surface portions on closure of the die sections.

13. A method as claimed in claim 1 wherein in said step of providing a tubular black the circumference of the tubular blank is such that forming said black to said final cross section expands the circumference of the black by no more than about 5%.

14. A method as claimed in claim 1 wherein in said step of pressurizing the blank internally to expand it, the expansion is about 0.4 to about 2%.

15. A method of forming a tubular member comprising:

(a) providing a die having therein a cavity having a cross section corresponding to a configuration of a desired final tubular member;

(b) providing a tubular blank having thereon an end portion having an initial cross section transverse to the longitudinal axis of the tubular blank;

(c) deforming the end portion of said tubular blank and providing it with a deformed end portion having a deformed cross section transverse to the longitudinal axis of the tubular blank different from said initial cross section;

(d) confining said tubular blank in said cavity;

(e) sealing said blank by applying to said deformed end portion a sealing member having a cross sectional profile corresponding to said deformed cross section;

(f) pressurizing the blank internally to expand it to define the shape of the cavity; and (g) releasing the pressure, removing the sealing member and withdrawing the expanded blank from the die;

and wherein in said step of providing a die, said die comprises die sections moving between open, intermediate and closed positions, each die section having a die cavity portion and a mating surface portion, which die sections in the closed position have the mating surface portion of each section in mating engagement with the mating surface portion of each adjacent section on the die cavity portions defining said cavity, and said step of deforming said end portion of said tubular blank comprises placing the blank between the die sections in the open position, and partially closing the die sections to said intermediate position for deforming said end portion, and wherein said sealing member is inserted into the deformed end before the blank is confined in the die by moving said die sections to the closed position.

16. A method as claimed in claim 15 wherein said initial cross section is wholly convex.

17. A method as claimed in claim 16 wherein in said initial cross section is substantially a circle.

18. A method as claimed in claim 15 wherein said cross section of said cavity is substantially polygonal.

19. A method as claimed in claim 18 wherein said cross section is substantially rectangular.

20. A method as claimed in claim 15 wherein, in said step of providing a die, at least one die section has an auxiliary clamp member connected thereon through a lost motion linkage, said auxiliary clamp member defining with at least one other die section a throat cavity having said deformed cross section, said auxiliary clamp member being biased toward said other die section and clamping and deforming said one end of the blank on movement of the said one die section from the open to said intermediate position, and retracting relative to said one die section and remaining substantially stationary relative to said other die section on movement of said die section from the intermediate to the closed position.

21. A method as claimed in claim 20 wherein said auxiliary clamp member clamps said one end of the blank before said one die section contacts the blank.

22. A method as claimed in claim 20 wherein before the die sections are moved from the intermediate to the closed position, the blank is pressurized to a first pressure insufficient to exceed the elastic limit of the wall of the blank and sufficient to avoid pinching of the blank between said mating surface portions on closure of the die sections.

* * * * *